US006176695B1

(12) United States Patent
Dye

(10) Patent No.: US 6,176,695 B1
(45) Date of Patent: Jan. 23, 2001

(54) CONTROL OF A LOBED ROTOR MACHINE

(75) Inventor: Anthony O. Dye, Girton (GB)

(73) Assignee: Rotary Power Couple Engines Limited, Linton (GB)

( * ) Notice: Under 35 U.S.C. 154(b), the term of this patent shall be extended for 0 days.

(21) Appl. No.: 09/362,085

(22) Filed: Jul. 28, 1999

Related U.S. Application Data

(63) Continuation of application No. PCT/GB98/00345, filed on Feb. 4, 1998.

(30) Foreign Application Priority Data

Feb. 5, 1997 (GB) ..... 9702342

(51) Int. Cl.[7] ..... F01C 1/16; F01C 21/14; F04C 18/16; F04C 29/08

(52) U.S. Cl. ..... 418/201.2

(58) Field of Search ..... 418/191, 201.2

(56) References Cited

U.S. PATENT DOCUMENTS

| | | | | |
|---|---|---|---|---|
| 2,369,539 | | 2/1945 | Delamere . | |
| 3,045,447 | * | 7/1962 | Wagenius | 418/191 |
| 4,579,513 | * | 4/1986 | Zimmern et al. | 418/201.2 |
| 4,667,646 | * | 5/1987 | Shaw | 418/201.2 |
| 5,090,392 | * | 2/1992 | Nakano et al. | 418/201.2 |

FOREIGN PATENT DOCUMENTS

| | | |
|---|---|---|
| 1118800 | 12/1961 | (DE) . |
| 162157 | 11/1985 | (EP) . |
| 484885 | 5/1992 | (EP) . |
| 2098662 | 11/1982 | (GB) . |
| 91/06747 | 5/1991 | (WO) . |

* cited by examiner

*Primary Examiner*—John J. Vrablik
(74) *Attorney, Agent, or Firm*—Pillsbury, Madison & Sutro - Intellectual Property Group

(57) ABSTRACT

A rotary device has a first rotor having a recess and a second rotor counter-rotatable to the first rotor and having a radial lobe. A housing in which the rotors are enclosed has a first arcuate recess, an edge of the recess of the first rotor forming a sliding seal with the first arcuate recess during a portion of the rotation of the first rotor. The housing has a second arcuate recess, the lobe of the second rotor forming a sliding seal with the second arcuate recess during a portion of the rotation of the first rotor. Thus, for a portion of the rotation of the rotors, there is defined between the first and second rotors and the arcuate recesses of the housing a transient chamber of volume which progressively decreases on rotation of the rotors. The maximum volume of the transient chamber can be varied.

13 Claims, 4 Drawing Sheets

CONTROL OF A LOBED ROTOR MACHINE

This is a Continuation of: International Application No. PCT/GB98/00345 filed Feb. 4, 1998.

FIELD OF THE INVENTION

The present invention relates to a rotary device.

BACKGROUND OF THE INVENTION

In WO-A-91/00-747, there is disclosed a rotary device having interacting rotors which have a helical form in their axial direction.

In an internal combustion engine using such a rotary device, there are separate rotary compression and expansion sections.

In a fluid compressor, the rotor pairs serve to compress and deliver compressible fluids into receivers in which the receiver pressure is substantially greater than that of the fluid source. Power is supplied by an external prime mover in order to drive the rotor pair and thus to compress the fluid, raising its pressure from that of the supply source to that of the receiver. For efficient operation of a positive displacement compressor, it is desirable to raise the pressure of the fluid charge to a level equal to that of the receiver before beginning to deliver the charge into the receiver. In the rotor system disclosed in WO-A-91/06747, there is a port in a side wall. Opening of the port is effected when the leading edge of a transfer passage in the rotor passes over the approach side of the port in the side wall. The timing of the opening of the port for the start of delivery of the charge is therefore determined by the location of the passage at a predetermined position in the recess of one rotor and is therefore incapable of adjustment during operation of the compressor. It is desirable to have means to adjust the initial charge volume so as to ensure equalisation of the charge pressure with that of the receiver at the instant at which the port begins to open. This is particularly important when the compressor does not operate with a reed valve and when the pressures of the fluid supply source and/or the receiver are not constant.

In a rotary internal combustion engine having rotor systems as disclosed in WO-A-91/06747, the rotors serve as positive and negative displacement systems, thereby effecting the volume changes which take place in the working fluid throughout the thermodynamic cycle of the engine. Most applications of internal combustion engines require power to be delivered over a range of shaft speeds and at varying torque loads. For internal combustion engines other than compression-ignition types, variation of the output power and engine speed is effected by varying the mass of working fluid used during the cycle. It is therefore desirable to provide means for varying the volume, and therefore the mass, of working fluid entrapped at the start of the cycle.

In both rotary devices of this type, i.e. in both compressor and internal combustion engine applications, it is desirable to be able to vary the maximum volume or mass of the charge during operation of the rotors.

SUMMARY OF THE INVENTION

According to the present invention, there is provided a rotary device, the device comprising: a first rotor rotatable about a first axis and having at its periphery a recess bounded by a curved surface; a second rotor counter-rotatable to said first rotor about a second axis, parallel to said first axis, and having a radial lobe bounded by a curved surface; the first and second rotors being coupled for rotation and being intermeshed; a housing in which the rotors are enclosed, the housing having a first arcuate recess which is coaxial with the first rotor, an edge of the recess of the first rotor forming a sliding seal with the first arcuate recess during a portion of the rotation of the first rotor, the housing having a second arcuate recess which is coaxial with the second rotor, the lobe of the second rotor forming a sliding seal with the second arcuate recess during a portion of the rotation of the first rotor, such that, for a portion of the rotation of the rotors, there is defined between the first and second rotors and the arcuate recesses of the housing a transient chamber of volume which progressively decreases on rotation of the rotors; and, varying means for varying the maximum volume of the transient chamber.

Thus, the maximum volume of the transient chamber can be varied, thereby allowing the pressure and/or volume of a fluid entrapped in the transient chamber to be varied prior to transfer of said fluid out of the transient chamber. The initial charge volume can be adjusted so as to ensure equalisation of the charge pressure with that of the receiver at the instant at which the port begins to open; this is particularly useful when the rotary device is used in a compressor. The volume, and therefore the mass, of working fluid entrapped at the start of the cycle can be varied; this is particularly useful when the rotary device is used in an internal combustion engine.

The varying means may comprise the housing arcuate recesses being formed in a section of the housing which is movable relative to the housing and rotors thereby to vary the maximum volume of the transient chamber.

Where provided, the movable section may conveniently be mounted on a linear bearing for reciprocating movement parallel to the axes of both rotors.

The rotary device preferably has side walls which define with the rotors the transient chamber, the side walls having recesses into which the movable section is movable.

Control means may be provided for controlling the varying means.

Where the rotary device is a compressor, pressure measuring means may be provided for measuring the pressure of a working fluid in the transient chamber and the pressure in a receiver to be supplied with compressed fluid from the transient chamber. Control means can be provided for controlling the varying means so that the pressure in the transient chamber is substantially equal to the pressure in a said receiver immediately prior to transfer of the working fluid from the transient chamber to a said receiver.

A reed valve may be provided in a delivery port between the transient chamber and a said receiver.

Control means may be provided for monitoring the difference between the pressure of a working fluid in the receiver and the maximum allowable pressure in the receiver and for controlling the varying means to adjust the delivery flow rate of working fluid from the transient chamber to a said receiver in accordance with usage of the compressed fluid.

Where the rotary device forms a portion of an internal combustion engine, operator control means may be provided for operator control of the position of the varying means.

Said rotor recess, rotor lobe, and housing arcuate recesses preferably extend helically in the axial direction.

The curved surfaces may be contoured such that during passage of said rotor lobe through said rotor recess, said recess surface is continuously swept, by both a tip of said lobe and a movable location on said lobe which location progresses along said lobe surface, to define said transient chamber.

The speed of rotation of the first, recessed, rotor is preferably lower than the speed of rotation of the second, lobed, rotor by a ratio, less than 1:1, of whole numbers.

Both rotors may have respectively equiangularly spaced recesses and lobes in the same ratio of recesses to lobes as the speed ratio. In a particular example, the first rotor has three equiangularly disposed recesses, and the second rotor has two diametrically opposed lobes, and the ratio of their speeds of rotation is 2:3.

BRIEF DESCRIPTION OF THE DRAWINGS

An embodiment of the present invention will now be described by way of example with reference to the accompanying drawings, in which.

DETAILED DESCRIPTION OF THE INVENTION

Figure 1:
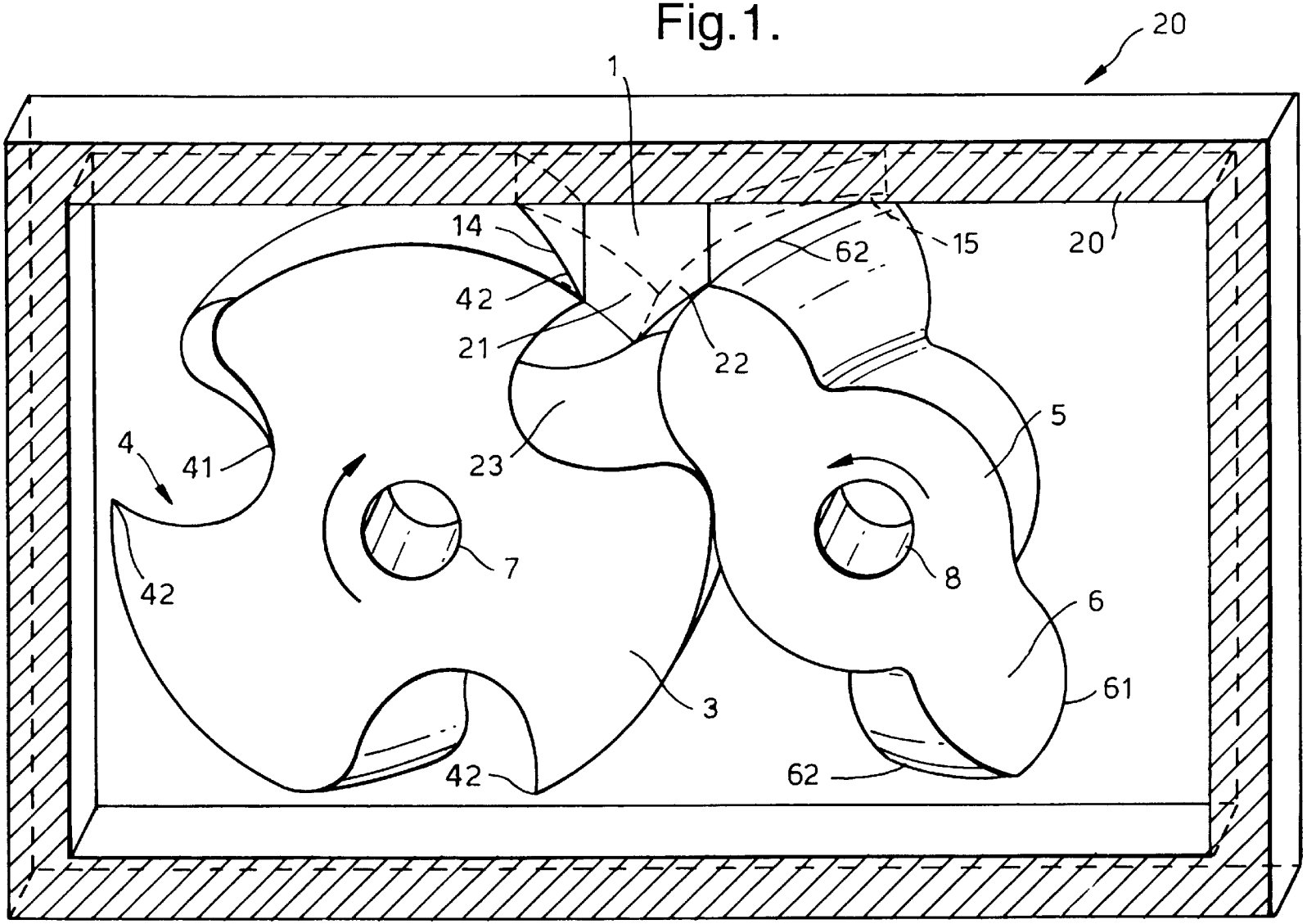
FIG. 1 is a schematic cross-sectional view of an example of a device of the present invention viewed from a first side.

The basic rotary device 30, in the form of an internal combustion engine, of the invention is similar to that disclosed in WO-A-91/06747. As such, the device 30 has two respective keyed compression rotors 3,5. The first rotor 3 has three equiangularly spaced recesses 4 at its periphery, each recess 4 being bounded by a curved surface 41 of the first rotor 3. The second rotor 5 has diametrically opposed lobes 6 extending therefrom, each lobe 6 being bounded by a curved surface 61 of the second rotor 5. The lobes 6 fit into and cooperate with the recesses 4 of the first rotor 3.

The rotors 3,5 are mounted on respective shafts 7,8. The shafts 7,8 are geared together by gears (not shown.) in a speed ratio of whole numbers. Preferably, the speed ratio is 2:3 where the first rotor 3 has three recesses 4 and second rotor 5 has two lobes 6.

The shafts 7,8 are mounted for rotation in bearings located in respective side walls 9,10 which are fixed either side of and parallel to the rotors 3,5. The rotors 3,5 are a substantially gas-tight sliding fit with the side walls 9,10.

The rotors 3,5 are enclosed by a housing 20. Indeed, one or both of the side walls 9,10 may be a part of the housing 20. The housing 20 is shaped to have a first arcuate recess 21 which is shaped so that the trailing edge 42 of each recess 4 of the first rotor 3 is a sliding fit with the first arcuate recess 21. The housing 20 is also shaped to have a second arcuate recess 22 which is shaped so that the leading edge 62 of a lobe 6 of the second rotor 5 is a sliding fit with the second arcuate recess 22 of the housing 20.

A transient chamber 23, which is shaded in FIG. 1, is formed between a recess 4 of the first rotor 3, a lobe 6 of the second rotor 5 and the arcuate recesses 21,22 of the housing 20 when the trailing and leading edges 42,62 of a recess 4 and lobe 6 respectively enter the arcuate recesses 21,22. The transient chamber 23 is used to compress a working fluid. The working fluid may simply be a fluid to be compressed when the device is a compressor. On the other hand, the working fluid might be air or an air/gas mixture if the rotary device is the compression section of a rotary internal combustion engine.

Figure 2:
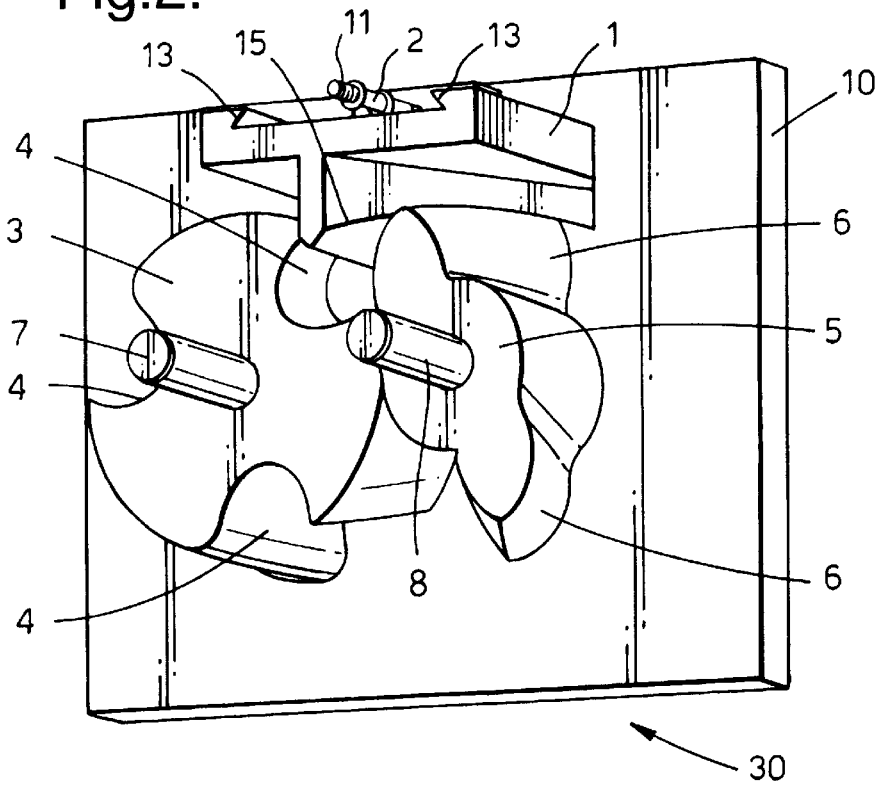
FIG. 2 is a schematic perspective view from the first side of the example of FIG. 1 with a side wall and housing removed for the purposes of clarity.
Figure 3:
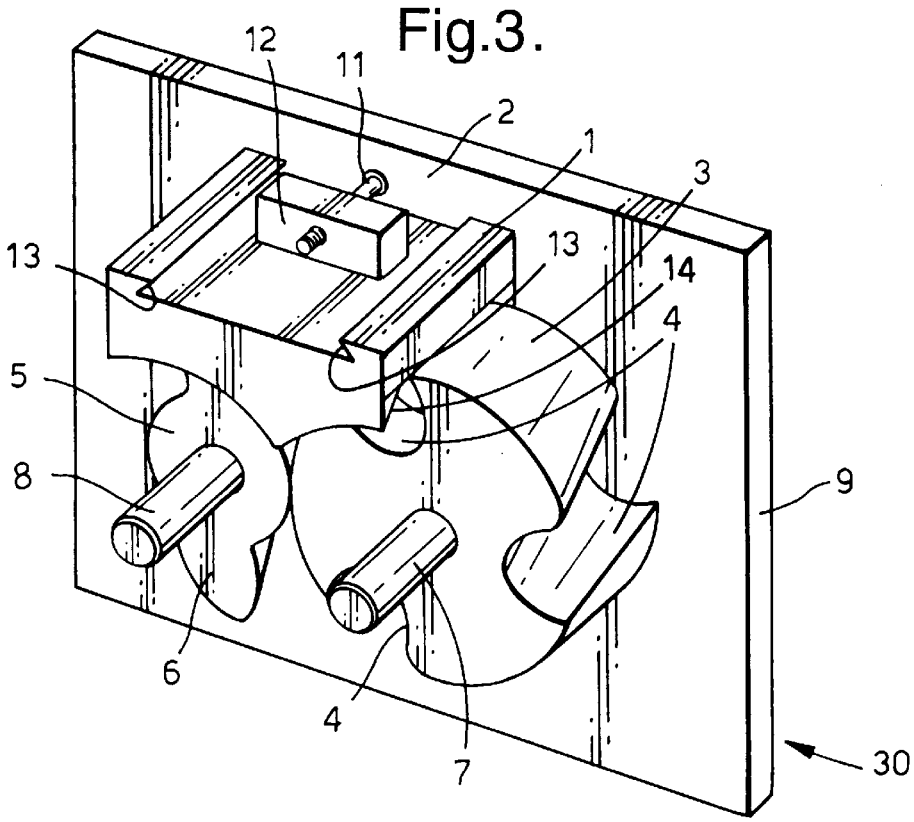
FIG. 3 is a view from the other side corresponding to FIG. 2.
Figure 4:
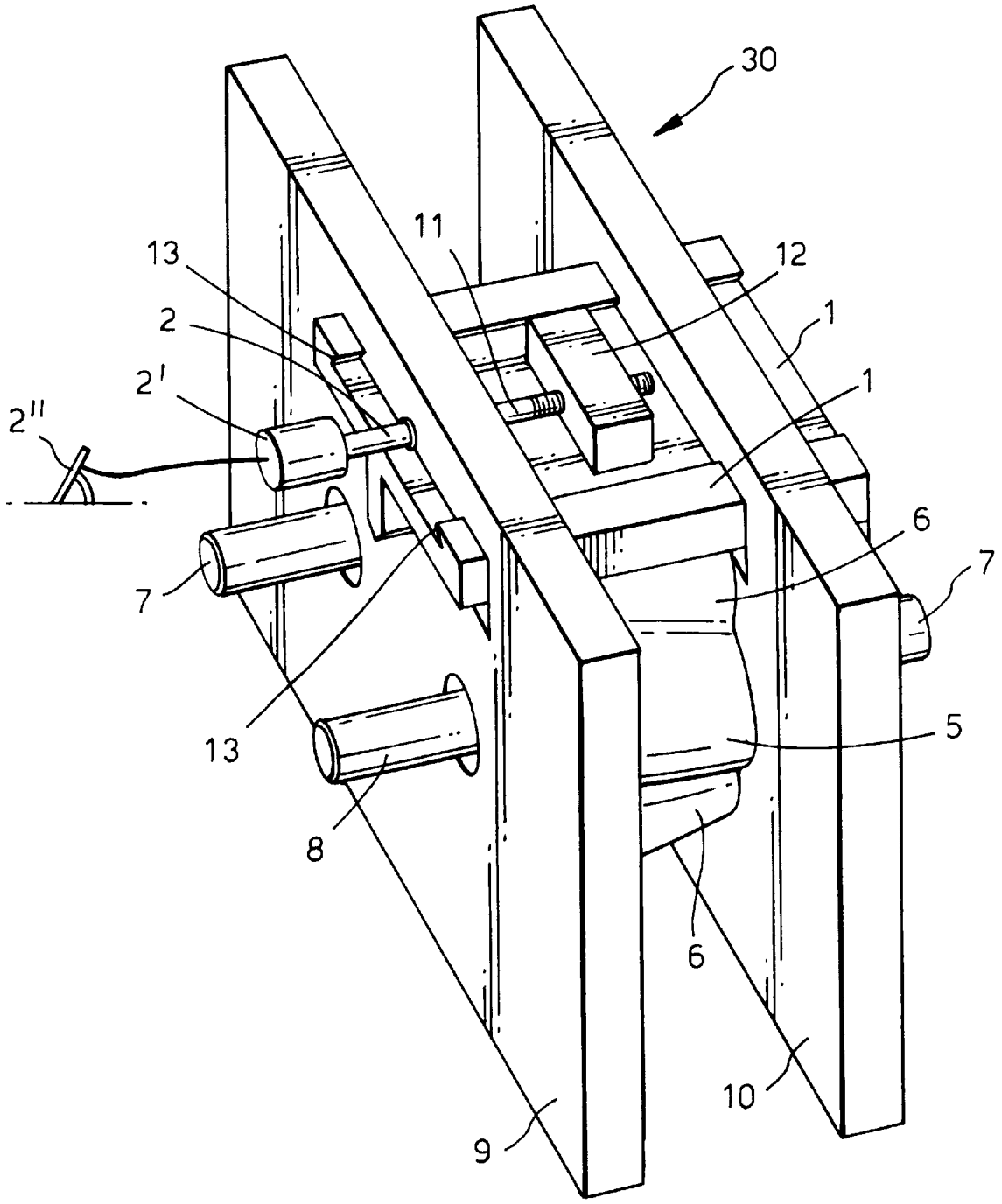
FIG. 4 is a perspective view of the example of the device showing both side walls; and, FIG. 5 is a further perspective view of the example with the side wall and housing not shown for the purposes of clarity.

The volume of the transient chamber 23 decreases as rotation of the rotors 3,5 proceeds from the position shown in FIG. 1 at which the leading edge 62 of a lobe 6 of the second rotor 5 is just about to enter the second arcuate recess 22 of the housing 20 and the trailing edge 42 of a recess 4 is just about to enter the first arcuate recess 21. As can be seen particularly clearly in FIGS. 2 and 3, the rotors 3,5 extend helically parallel to their respective axes. The helix angles of the rotors 3,5 match their respective rotational speeds so that the ratio of the helix angles is the same as the ratio of the rotational speeds of the rotors 3,5. For example, the helix angle for the first, recessed rotor 3 may be 20° and the helix angle for the second, lobed rotor 5 may be 30°. The arcuate recesses 21,22 are helically shaped to match the helical shapes of the recesses 4 and lobes 6.

In the present invention, at least a portion or section 1 of the housing 20 which defines the arcuate recesses 21,22 is movable parallel to the axes of rotation of the rotors 3,5. The movable section 1 is of greater axial length than the rotors 3,5 and extends into recesses provided in the side walls 9,10 to accommodate the movable section 1. The movable section 1 has outer edges 14,15 which are shaped appropriately to register respectively and simultaneously with the entire axial length of the trailing edge 42 of a recess 4 on the first rotor 3 and the corresponding entire axial length of the tip or leading edge 62 of a lobe 6 on the second rotor 5. In other words, the movable section 1 of the housing 20 has a wall segment edge 14 which aligns with the whole length of the trailing edge 42 of a recess 4 of the first rotor 3 and a wall segment edge 15 which aligns simultaneously with the whole length of the tip or leading edge 62 of a lobe 6 of the second rotor 5.

The movable section 1 is mounted on a linear bearing 13 for reciprocating movement into and out of the respective recesses in the side walls 9,10. A control device 2 is provided to control movement back and forth of the movable section 1. The control device 2 may be a mechanical or electromechanical device for example. In the example shown, the control device 2 includes a screw-threaded rod 11 which can be rotated in a correspondingly threaded block fixed to the movable section 1 of the housing 20. A motor or electromagnet for driving the movable section 1 back and forth is indicated at 2' in the drawings. The radial clearance with the first and second rotors 3,5 is maintained throughout the reciprocating movement of the movable section 1.

As the movable section 1 is moved back and forth parallel to the axes of the rotors 3,5 (i.e. parallel to the rotation shafts 7,8 on which the rotors 3,5 are mounted), the maximum volume of the transient chamber 23 defined between the rotors 3,5 and the arcuate recesses 21,22 of the housing 20 varies. In the preferred embodiment, where the rotors 3,5 and the housing arcuate recesses 21,22 extend helically in the axial direction, this variation of the maximum volume of the transient chamber 23 takes place simply by virtue of the reciprocating movement of the movable section 1. As will be understood from a study of the drawings, the further the movable section 1 is moved in the direction away from the wall 10 shown in FIG. 2, the earlier will occur the simultaneous register of the edges 42,62 of the recess 4 of the first rotor 3 and the lobe 6 of the second rotor 5 respectively with the arcuate recesses 21,22 of the housing 20. This will correspond with a greater volume of working fluid entrapped in the transient chamber 23 at this point of the cycle of the device 30. Adjustment of the axial position of the movable section 1 towards the wall 10 shown in FIG. 2 will conversely result in a smaller maximum volume of the transient chamber 23 during a cycle of the device 30.

Following final compression of the working fluid in the transient chamber 23, the working fluid in the case of a compressor is passed to a receiver via a delivery port 18 and a passage 19 located in one of the side walls 10; the passage 19 in this case preferably maintains the same cross-sectional shape and size as the delivery port 18. In the case of an internal combustion engine, the passage 19 provides the combustion chamber and may have a cross-sectional shape and size which varies from that of the delivery port 18 according to the requirements of the combustion engine.

An orifice 16 is provided adjacent to the delivery port 18. The orifice 16 leads to a pressure transducer 16A the diaphragm of which is flush with the inner surface of the side wall 10 so that the pressure transducer 16A can monitor the maximum pressure reached in the transient chamber 23. The maximum pressure is reached just prior to opening of the delivery port 18.

Figure 5:
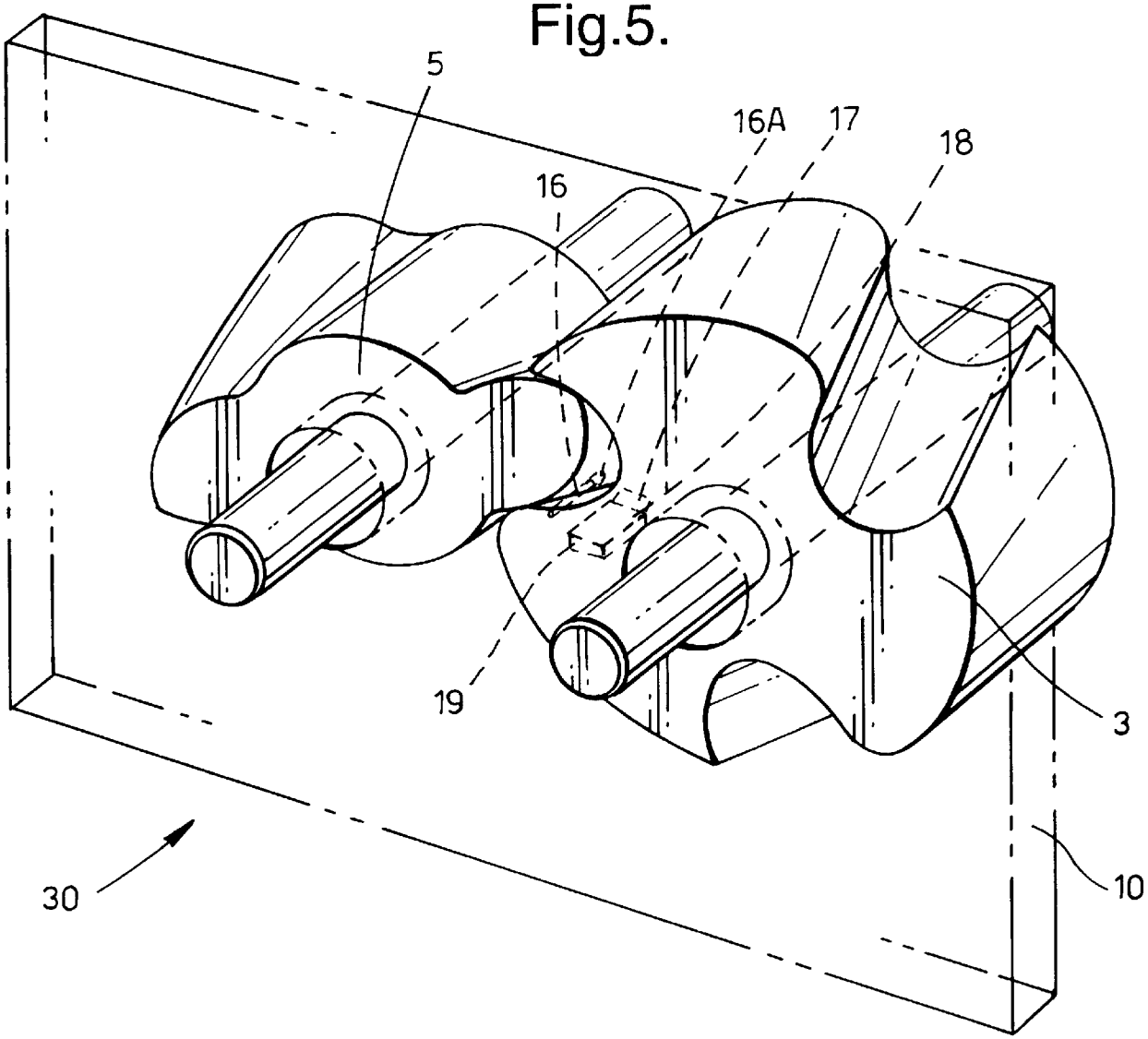

FIG. 5 shows the position immediately prior to opening of the delivery port 18 at which the pressure of the fluid in the transient chamber 23 is a maximum. In the case of a compressor, the pressure in the transient chamber 23 is substantially equal to the pressure in the receiver. Thus, in the case of a compressor, as the rotors 3,5 rotate further, the leading edge of a chamfered groove 17 in the recess 4 of the first rotor 3 traverses the approach side of the delivery port 18 and fluid can be delivered through the delivery port 18 without any change in pressure. Further movement of the rotors 3,5 exposes an increasingly large flow area of the delivery port 18 until the trailing edge of the chamfered groove 17 traverses the approach side of the delivery port 18. With further rotation of the rotors 3,5, the area of the delivery port gradually decreases to zero when the trailing edge of the chamfered groove 17 traverses the retreat side of the delivery port 18. Preferably, closing of the delivery port 18 is timed to coincide with the reduction to a minimum (clearance) volume of the transient chamber 23.

In the case of an engine, the design of the leading edge of the chamfered groove 17 and the design of the profile of the delivery port 18 are such as to allow delivery of the fluid from the transient chamber 23 into the combustion chamber at an earlier stage in the cycle as the residual pressure in the combustion chamber before charging is near ambient.

A reed valve may be used in the delivery port 18 when wide variation occurs in both the receiver pressure and the rate of use of the compressed fluid, such as in a workshop compressed air supply system serving a wide range of tools, none of which requires close limits on the supply pressure. In such a case, the movable section 1 of the housing wall serves mainly to vary the mass flow of delivery to match that of the variable rate of fluid use. On the other hand, where the pressure in the receiver varies very little, such as in the case of a precision air compressor delivery system, a reed valve may not be necessary as the movable section 1 of the housing may be sufficient to provide all the necessary variation in delivery which is required to avoid repeated stopping and starting of the rotary device whilst maintaining high efficiency at all rates of delivery.

When the rotary device is used in an internal combustion engine, the control device 2 controlling the axial movement of the movable section 1 can be directly linked to a power and/or speed control, such as a foot pedal 2", for use by the operator of the engine.

An embodiment of the present invention has been described with particular reference to the example illustrated. However, it will be appreciated that variations and modifications may be made to the example described within the scope of the present invention.

What is claimed is:

1. A rotary device, the device comprising:

a first rotor rotatable about a first axis and having at its periphery a recess bounded by a curved surface;

a second rotor counter-rotatable to said first rotor about a second axis, parallel to said first axis, and having a radial lobe bounded by a curved surface;

the first and second rotors being coupled for rotation and being intermeshed;

a housing in which the rotors are enclosed, the housing having a first arcuate recess which is coaxial with the first rotor, an edge of the recess of the first rotor forming a sliding seal with the first arcuate recess during a portion of the rotation of the first rotor, and the housing having a second arcuate recess which is coaxial with the second rotor, the lobe of the second rotor forming a sliding seal with the second arcuate recess during a portion of the rotation of the first rotor, such that, for a portion of the rotation of the rotors, there is defined between the first and second rotors and the arcuate recesses of the housing transient chamber of volume which progressively decreases on rotation of the rotors; and, said rotor recess, said rotor lobe, and said housing arcuate recesses extending helically in the axial direction, and the housing arcuate recesses being formed in a section of the housing which is axially movable relative to said housing and said rotors, whereby axial movement of said movable section varies the maximum volume of the transient chamber.

2. A rotary device according to claim 1, comprising side walls which define with the rotors the transient chamber, the side walls having recesses into which the movable section is movable.

3. A rotary device according to claim 1, comprising a control device to control movement of the movable section.

4. A rotary device according to claim 1, the rotary device forming a portion of an internal combustion engine, the device comprising an operator control device whereby the operator can control the position of the movable section.

5. A rotary device according to claim 1, wherein the curved surfaces are contoured such that during passage of said rotor lobe through said rotor recess, said recess surface is continuously swept, by both a tip of said lobe and a movable location on said lobe which location progresses along said lobe surface, to define said transient chamber.

6. A rotary device according to claim 1, wherein the movable section is mounted on a linear bearing for reciprocating movement parallel to the axes of both rotors.

7. A rotary device according to claim 6, comprising side walls which define with the rotors the transient chamber, the side walls having recesses into which the movable section is movable.

8. A rotary device according to claim 1, the device being a compressor, comprising pressure measuring means for measuring the pressure of a working fluid in the transient chamber and the pressure in a receiver to be supplied with compressed fluid from the transient chamber.

9. A rotary device according to claim 8, comprising control means for controlling movement of the movable section so that the pressure in the transient chamber is substantially equal to the pressure in a said receiver immediately prior to transfer of the working fluid from the transient chamber to a said receiver.

10. A rotary device according to claim 8, comprising a reed valve in a delivery port between the transient chamber and a said receiver.

11. A rotary device according to claim 10, comprising control means for monitoring the difference between the pressure of a working fluid in a said receiver and the maximum allowable pressure in a said receiver and for controlling movement of the movable section to adjust the delivery flow rate of working fluid from the transient chamber to a said receiver in accordance with the usage of the compressed fluid.

12. A rotary device according to claim 1, wherein the speed of rotation of the first, recessed, rotor is lower than the speed of rotation of the second, lobed, rotor by a ratio, less than 1:1, of whole numbers.

13. A rotary device according to claim 12, wherein both rotors have respectively equiangularly spaced recesses and lobes in the same ratio of recesses to lobes as the speed ratio.

* * * * *